US006036481A

United States Patent [19]

Legutko et al.

[11] Patent Number: 6,036,481

[45] Date of Patent: Mar. 14, 2000

[54] BURNER WITH FLAME RETAINER INSERT

[75] Inventors: Thomas J. Legutko, Canastota; Timothy J. Tifft, Liverpool, both of N.Y.

[73] Assignee: Carrier Corporation, Syracuse, N.Y.

[21] Appl. No.: 09/035,865

[22] Filed: Mar. 6, 1998

[51] Int. Cl.[7] ..... F23D 14/58

[52] U.S. Cl. ..... 431/354; 431/114; 431/349; 239/601; 239/552; 239/558

[58] Field of Search ..... 431/354, 355, 431/349, 350, 181, 187, 114; 239/567, 568, 553.5, 552, 557, 556, 548, 553.3, 561, 498, 601, 597, 565, 589, 599, 558, 596, 559, 553

[56] References Cited

U.S. PATENT DOCUMENTS

| | | | |
|---|---|---|---|
| 1,231,726 | 7/1917 | Gault, Jr. | 431/349 |
| 1,863,100 | 6/1932 | Coleman . | |
| 1,923,393 | 8/1933 | Pickup . | |
| 4,142,456 | 3/1979 | Locker . | |
| 4,348,170 | 9/1982 | Vatsky et al. . | |
| 4,589,426 | 5/1986 | Reinecke . | |
| 5,108,284 | 4/1992 | Gruswitz | 431/286 |

FOREIGN PATENT DOCUMENTS

| | | | |
|---|---|---|---|
| 94558 | 2/1935 | Sweden | 239/552 |

*Primary Examiner*—Carl D. Price
*Attorney, Agent, or Firm*—William W. Habelt

[57] ABSTRACT

An inshot burner (10) includes an axially elongated tubular nozzle (40) having a flared inlet end (42), a cylindrical outlet end (44) and a venturi section (46) therebetween. A burner head insert (20) is disposed within the cylindrical outlet end 44. The burner head insert (20) has an axially elongated annular body (22) having an axially extending inner flow passage (25) passing therethrough and a plurality of circumferentially spaced, axially extending splines (30) radiating outwardly therefrom toward the surrounding wall of the outlet end (44) of the burner tube. A plurality of second flow passages (35) are defined between the plurality of splines (30). Each of the axially extending splines (30) has a cross width which enlarges in the axial direction from the inlet end of the burner head insert to the outlet end of the burner head insert.

3 Claims, 1 Drawing Sheet

BURNER WITH FLAME RETAINER INSERT

BACKGROUND OF THE INVENTION

Gas fired appliances, such as residential and light commercial heating furnaces, often use a particular type of gas burner commonly referred to as an inshot burner. In this type of burner, fuel gas under pressure passes through a central port disposed at the inlet of a venturi burner nozzle. Atmospheric air is drawn into the burner nozzle and mixes with the fuel gas as it passes through the burner nozzle. In some constructions, a burner head insert, also referred to as a flame retention insert, made of compressed sintered or powdered metal is mounted in the outlet end of the tube. In operation, gas is injected into the inlet end of the nozzle, entraining air into the nozzle with it. This primary air/gas mix flows through the tube to the burner head insert. The primary air/gas mix passes through outlet openings defined by the insert and burns as it exits the insert forming a flame projecting downstream from the burner head insert. Secondary air flows around the outside of the venturi tube and is entrained in the burning mixture downstream of the insert in order to provide additional air to complete combustion.

Some of the problems associated with conventional inshot burner designs are ignition, flame stability, noise and nitrogen oxides formation. Ignition problems can arise when the ignition location is critical. The velocity of the primary air/gas flow from the insert is often greater than the flame speed. Under this condition, the flame lifts off from the burner insert, i.e. the flame begins to burn at a location spaced from the outer face of the flame retention insert. Flame liftoff is a major cause of the noise associated with the operation of inshot burner nozzles. If the velocity of the air/gas mixture is too slow when compared to the flame speed, flashback can occur. Flashback is the burning of the gas within the burner nozzle itself. This condition can cause overheating and deterioration of the nozzle.

Various flame retention or burner head inserts have been designed in the past in an attempt to achieve better flame stability and reduction of noise. One known insert comprises a cylindrical body defining a central opening and having a toothed perimeter formed by a plurality of circumferentially spaced, axially elongated splines extending radially outwardly in a sunburst pattern about the circumference of the cylindrical body. In conventional prior art sunburst type inserts, each spline comprises an axially elongated bar of rectangular cross-section. The air/gas mixture passing through the central opening of the insert forms an inner flame cone, while the air/gas mixture passing through the circumferentially spaced openings between the sunburst arrayed splines forms an outer flame cone. Another known insert has a central opening surrounded by a series of circumferentially spaced, small holes. In both designs, the velocities of air/gas flow through the outer series of openings and the central opening are nearly the same.

During the combustion of fossil fuels, including gaseous fuels such as natural gas, liquefied natural gas and propane, for example, in air, oxides of nitrogen ($NO_x$) are formed and emitted to the atmosphere in the combustion products. With respect to gaseous fuels which contain little or no nitrogen per se, $NO_x$ is formed as a consequence of oxygen and nitrogen in the air reacting at the high temperatures resulting from the combustion of the fuel. As oxides of nitrogen emitted to the atmosphere are considered a noxious pollutant, it is desirable to reduce the formation of nitrogen oxides within the flame.

SUMMARY OF THE INVENTION

It is an object of this invention to reduce the formation of nitrogen oxides during combustion of the fuel gas.

It is another object of this invention to provide an improved inshot gas burner nozzle which is characterized by reduced nitrogen oxides formation.

It is further object of this invention to provide an improved burner head insert for an inshot gas burner nozzle which is characterized by reduced nitrogen oxides formation.

The inshot burner nozzle of the present invention includes an axially elongated tube having an inlet end for receiving gaseous fuel and atmospheric air, an enlarged outlet end and a venturi section therebetween, and a burner insert supported within the enlarged outlet end. A burner head insert, having an axially elongated annular body having an axially extending inner opening passing therethrough and a plurality of circumferentially spaced, axially extending splines radiating outwardly therefrom, is disposed within the outlet end of the burner tube. The inner opening defines an inner flow passage, while the spaced openings between the splines form a plurality of outer flow passages surrounding the inner opening.

In accordance with the invention, each of the splines has a cross width which enlarges in the axial direction from the inlet end of the burner insert to the outlet end of the burner insert. By providing a taper to the splines, the flow area of each of the flow passages defined between the splines is larger at the inlet end than at the outlet end. As a result of the flow passages being more open at the inlet end and becoming narrower and less open at the outlet end, the pressure drop through the burner head insert is reduced relative to the conventional uniform width splined burner head inserts. As a result, formation of nitrogen oxides is reduced. Additionally, when propane is burned, the occurrence of "yellow tipping " in the flame is also reduced.

DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
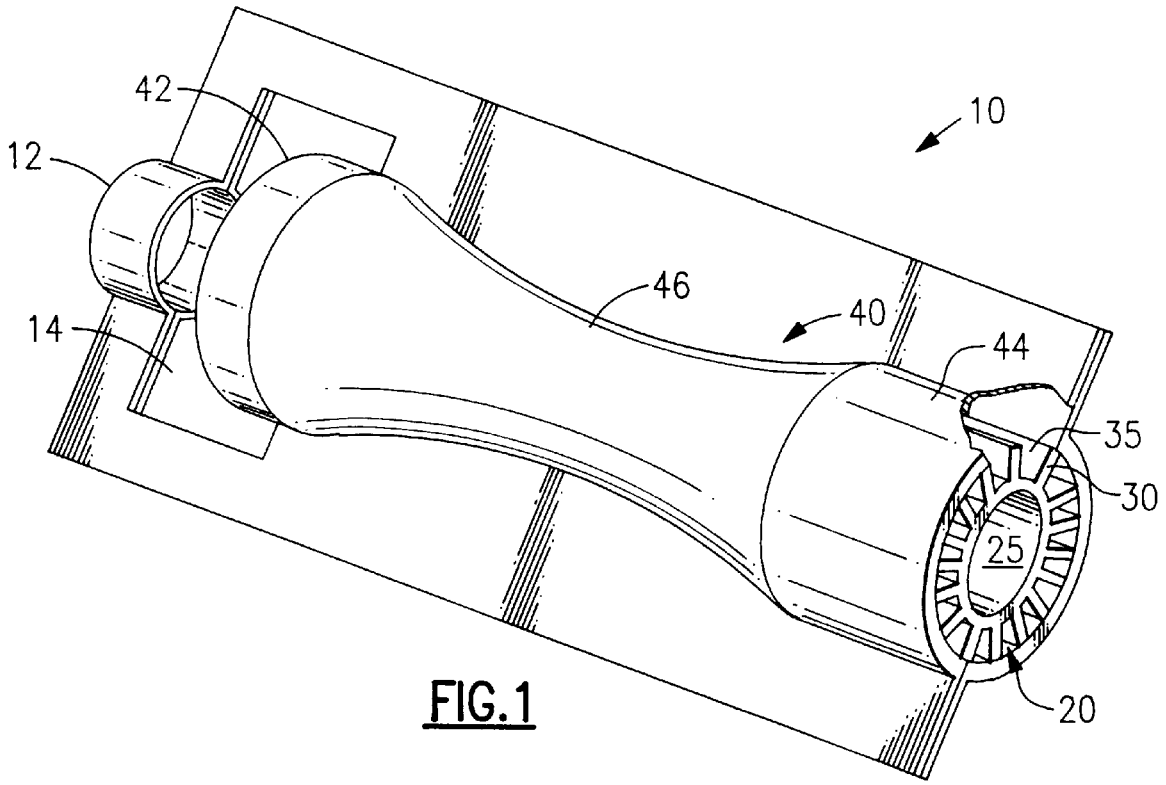
FIG. 1 is a pictorial view of the inshot burner of the present invention.

Referring now to the drawing, there is depicted pictorially in FIG. 1, a gaseous fuel burner 10 of the general type commonly referred to as an inshot burner. The burner 10 includes an axially elongated tubular nozzle 40 having a flared inlet end 42, a cylindrical outlet end 44 and a venturi section 46 therebetween. A burner head insert 20 is disposed within the cylindrical outlet end 44. In accordance with the present invention, the burner head insert 20 has a plurality of axially tapered splines 30.

A fuel gas port 12, spaced upstream of an coaxial with the inlet end 42 of the nozzle 40, is provided for connection to a fuel gas supply. The flared inlet end 42 has a larger diameter inlet opening than the fuel gas inlet opening defined by the fuel gas port 12, thereby defining an annular region 14 therebetween. In operation, primary combustion air is aspirated through the annular region 14 into the nozzle 40 as the pressurized fuel gas pass through the port 12 into the nozzle 40. Secondary combustion air passes around the outside of the nozzle 40 and gradually mixes into the flame extending axially downstream from the outlet of the burner.

Figure 3:
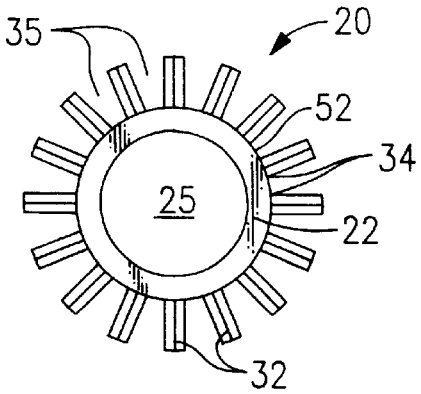
FIG. 3 is an end view of the burner head insert taken in the direction indicated by the arrow A on FIG. 2.
Figure 2:
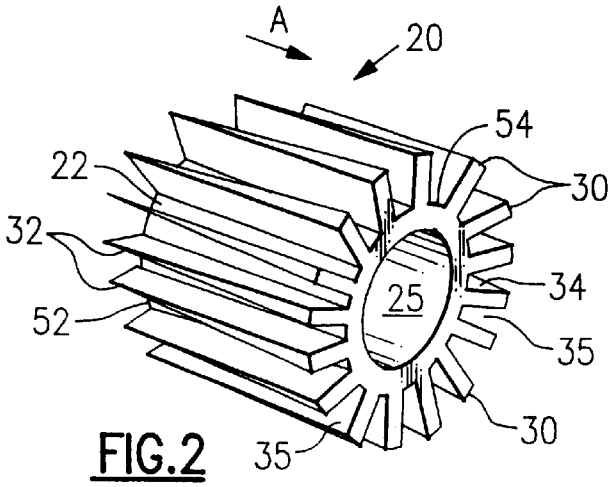
FIG. 2 is a pictorial view of the burner head insert.

Referring now to FIGS. 2 and 3, the burner head insert 20 comprises an axially elongated annular body 22 having an axially extending inner flow passage 25 passing therethrough and a plurality of circumferentially spaced, axially extending splines 30 radiating outwardly therefrom toward the surrounding wall of the outlet end of the burner tube. The burner head insert 20 is formed in a conventional manner out of conventional materials as used in prior art burner head inserts, such as for example sintered or powdered metal. A plurality of second flow passages 35 are defined between the plurality of splines 30. In operation, a first portion of the fuel-air mixture passes through the inner opening 25 to form an inner flame cone. At the same time, a second portion of the fuel-air mixture passes through the plurality of second flow passages 35 surrounding the an inner flow passage 25 to form an outer flame cone about the inner flame cone.

In accordance with the invention, each of the axially extending splines 30 has a cross width which enlarges in the axial direction from the inlet end of the burner head insert 20 to the outlet end of the burner head insert. In the preferred embodiment depicted in the drawing, each of the splines 30 linearly tapers outwardly in cross width, i.e. in the circumferential direction from an apex 32 at the inlet end 52 of the burner head insert 20 to a base 34 at the outlet end 54 of the burner head insert 20. By providing such a taper to the splines 30, the flow area of each of the flow passages 35 defined between the splines 30 is larger at the inlet end 52 than at the outlet end 54. As noted hereinbefore, as a result of the flow passages 35 being more open at the inlet end and becoming narrower and less open at the outlet end, the pressure drop through the burner head insert 20 is reduced relative to the conventional splines of uniform crosswidth common to prior art burner head inserts, thereby resulting in a reduction in nitrogen oxides formation in the flame.

Although a preferred embodiment of the present invention has been described and illustrated, other changes will occur to those skilled in the art. It is therefore intended that the scope of the present invention is to be limited only by the scope of the appended claims.

What is claimed is:

1. A burner insert for placement within an outlet end of an inshot burner nozzle, said burner insert comprising an axially elongated annular body having an axially extending inner opening passing therethrough defining an inner flow passage and a plurality of circumferentially spaced, axially extending splines radiating outwardly therefrom defining a plurality of outer flow passages between said splines, said burner insert characterized in that:

each of said splines has a cross width which enlarges in the axial direction from a leading edge apex at a first axial end of said burner insert to a second axial end of said burner and;

each of said plurality of outer flow passages has a cross width which narrows as the cross width of said splines enlarges in the axial direction from the first axial end to the second axial end of said burner insert.

2. An inshot burner nozzle comprising:

an axially elongated tube having an inlet end for receiving gaseous fuel and atmospheric air, and an outlet end; and a burner insert supported within said outlet end, said burner insert having an axially elongated annular body having an axially extending inner opening passing therethrough defining an inner flow passage and a plurality of circumferentially spaced, axially extending splines radiating outwardly the annular body thereby defining a plurality of outer flow passages between said splines and said outlet end of the tube, said burner insert characterized in that:

each of said splines has a cross width which enlarges in the axial direction from a leading edge apex at a first axial end of said burner insert distally disposed relative said outlet end to a second axial end of said burner insert proximately disposed relative said outlet end, and each of said plurality of outer flow passages has a cross width which narrows as the cross width of said splines enlarges in the axial direction from the first axial end to the second axial end of said burner insert.

3. An inshot burner nozzle as recited in claim 2 further characterized in that said axially elongated tube includes a venturi section disposed between the inlet end and the outlet end thereof.

* * * * *